US005651699A

United States Patent [19]

Holliday

[11] Patent Number: 5,651,699

[45] Date of Patent: Jul. 29, 1997

[54] MODULAR CONNECTOR ASSEMBLY FOR COAXIAL CABLES

[76] Inventor: Randall A. Holliday, 10045 Meade Ct., Westminster, Colo. 80030

[21] Appl. No.: 454,632

[22] Filed: May 31, 1995

Related U.S. Application Data

[63] Continuation-in-part of Ser. No. 210,480, Mar. 21, 1994, Pat. No. 5,501,616.

[51] Int. Cl.[6] ..... H01R 17/04

[52] U.S. Cl. ..... 439/585; 439/582

[58] Field of Search ..... 439/578, 585, 439/655, 322, 320, 584, 582

[56] References Cited

U.S. PATENT DOCUMENTS

| | | | |
|---|---|---|---|
| 3,196,382 | 7/1965 | Morello, Jr. | 439/585 |
| 3,355,698 | 11/1967 | Keller | 339/97 |
| 3,363,222 | 1/1968 | Karol | 339/221 |
| 4,400,050 | 8/1983 | Hayward | 339/177 |
| 4,553,806 | 11/1985 | Forney, Jr. et al. | 339/94 |
| 4,668,043 | 5/1987 | Saba et al. | 339/177 |
| 4,684,201 | 8/1987 | Hutter | 339/177 R |
| 4,755,152 | 7/1988 | Elliott et al. | 439/452 |
| 4,806,116 | 2/1989 | Ackerman | 439/304 |
| 5,073,129 | 12/1991 | Szegda | 439/585 |
| 5,230,640 | 7/1993 | Fardif | 439/578 |
| 5,501,616 | 3/1996 | Holliday | 439/585 |

*Primary Examiner*—Daniel W. Howell
*Attorney, Agent, or Firm*—John E. Reilly

[57] ABSTRACT

A terminal connector assembly for connecting coaxial cables to a selected device, such as, a cable television is made up of an adaptor and socket in press-fit relation to one another with an end connector at one end of the adaptor having endless sealing rings along an inner wall surface of an outer sleeve of the connector and spaced serrations or gripping edges along an external wall surface of an inner sleeve so that when the cable is inserted into the end connector with the outer conductor and jacket in the annular space between the inner and outer sleeves, the outer sleeve can be crimped inwardly to cause the ribs to advance into uniform sealed engagement with the jacket and the gripping edges will cooperate in resisting any tendency of the cable to separate from the end connector. The socket portion either can be directly attached to a cable television terminal or wall plate or may include a second end connector for crimped connection to another coaxial cable extending from the terminal or wall plate.

14 Claims, 2 Drawing Sheets

MODULAR CONNECTOR ASSEMBLY FOR COAXIAL CABLES

CROSS-REFERENCE TO RELATED APPLICATIONS

This application is a continuation-in-part patent application of Ser. No. 210,480, filed 21 Mar., 1994 for END CONNECTOR FOR COAXIAL CABLE, now U.S. Pat. No. 5,501,616 by Randall A. Holliday.

BACKGROUND AND FIELD OF INVENTION

This invention relates to fittings for connecting coaxial cables to a selected device, such as, a post or terminal customarily used in cable television; and more particularly relates to a novel and improved end connector for electrically and mechanically connecting a fitting in sealed engagement with a coaxial cable.

Coaxial cables are generally characterized by being made up of inner and outer concentric conductors separated by a dielectric insulator and encased or covered by an outer jacket of rubber or rubber-like material. Numerous types of end connectors have been devised to effect a secure mechanical and electrical connection to the end of the coaxial cable and in such a way that the inner conductor and dielectric insulator extend through an inner sleeve of the connector while the outer conductor and jacket are inserted into an annular space between the inner sleeve and an outer concentric sleeve. The outer concentric sleeve is then crimped in a radial inward direction to securely clamp the end of the cable within the connector, and a fastener on the opposite end of the connector is then connected to the post or terminal. Representative of end connectors that have been devised for this purpose is that disclosed in U.S. Pat. No. 5,073,129 to Szegda which employs a combination of external ribs and internal serrations along the crimping sleeve in order to assure a reliable electrical connection and mechanical coupling between the cable and end connector. U.S. Pat. No. 4,400,050 to Hayward similarly employs a plurality of serrations along an internal surface of the crimping sleeve but which are specifically intended and designed to engage the outer conductor of the cable which is doubled over the external surface of the Jacket and is concerned more with establishing firm gripping engagement with the end of the cable. Other patents of interest are U.S. Pat. No. 3,355,698 to Keller, U.S. Pat. No. 3,363,222 to Karol, U.S. Pat. No. 4,553,806 to Forney et al, U.S. Pat. No. 4,668,043 to Saba et al, U.S. Pat. No. 4,684,201 to Hutter, U.S. Pat. No. 4,755,152 to Elliot et al and U.S. Pat. No. 4,806,116 to Ackerman.

There is a continuing need for a one-piece end connector which is capable of establishing uniform sealed engagement between the connector and coaxial cable and which is conformable for use with different sized cables but nevertheless achieves the necessary weather-tight seal as well as secure mechanical coupling between the elements while avoiding the necessity of using separate sealing members or materials. Moreover, it is highly desirable that the end connector be conformable for use with different types of terminal connections as well as for splicing to another cable in such a way as to effect a secure, sealed connection of the cable to the connection or other cable.

SUMMARY OF THE INVENTION

An object of the present invention is to provide for a novel and improved modular connector assembly for positively connecting coaxial cables to terminal connections, wall plates or for splicing cables together.

It is another object of the present invention to provide for a connector fitting capable of effecting sealed engagement with one end of a coaxial cable and of being interchangeable for use with different sizes and types of terminal connections.

It is a further object of the present invention to provide for a novel and improved terminal connector assembly for coaxial cables which is interchangeable for use with different diameters of cables and is deformable by crimping into uniformly sealed engagement with one end of the cable.

It is an additional object of the present invention to provide for a novel and improved connector fitting having an outer smooth crimping surface for ease of engagement and uniform clamping by a crimping tool into sealed engagement with one end of a coaxial cable; and wherein the fitting is adaptable for positive threaded connection to different types of terminal, wall plates and for splicing cables together.

In accordance with the present invention, a modular connector assembly has been devised for connecting an end of a coaxial cable to a terminal or post wherein the cable is a standard cable having radially inner and outer, generally cylindrical conductors separated by an annular dielectric, an outer tubular jacket of rubber or rubber-like material encasing the outer conductor and with a portion of the outer conductor being exposed at the end of the cable, the connector comprising radially inner and outer spaced coaxial sleeves, the inner sleeve being sized for insertion of the inner conductor and annular dielectric therein, the outer sleeve being sized for insertion of the outer conductor and jacket through one end of the connector between the inner and outer sleeves, a rib extending circumferentially around an inner wall surface portion of the outer sleeve adjacent to the one end of the outer sleeve, the rib engaging an external surface of the jacket only when the cable is fully inserted into the connector and the outer sleeve is deformed radially inwardly until the rib effects sealed engagement with the jacket, and a threaded end portion in the end connector is complementary to the threading on the existing terminal connector for connecting the connector to the terminal or post.

In preferred and modified forms of the invention, one or more ribs or sealing rings are provided adjacent to the entrance end of the outer sleeve, each rib having an inner rounded surface deformable into a portion of the jacket until the jacket occupies a circumferentially extending space between each adjacent pair of the ribs, and the inner sleeve has external projections along an external wall surface of the inner sleeve adjacent to the one end. The outer sleeve is given an external smooth surface whereby to facilitate crimping with a circular crimping tool which will uniformly reduce the diameter of the outer sleeve and cause the ribs to advance into uniform sealed engagement with the jacket. The terminal connector has an adaptor and socket which serve to facilitate connection of the end connector to a terminal or wall plate, the adaptor and socket either being coaxial or at right angles to one another depending upon the space limitations at the point of installation. In the event that it is necessary to splice or connect the one coaxial cable to another coaxial cable at the terminal, the socket portion is provided with a second end connector corresponding to the end connector described and which is crimped in the same manner to the other coaxial cable to complete the connection.

The above and other objects of the present invention will become more readily appreciated and understood from a consideration of the following detailed description of preferred and modified forms of the present invention when taken together with the accompanying drawings in which:

DETAILED DESCRIPTION OF A PREFERRED EMBODIMENT

Figure 1:
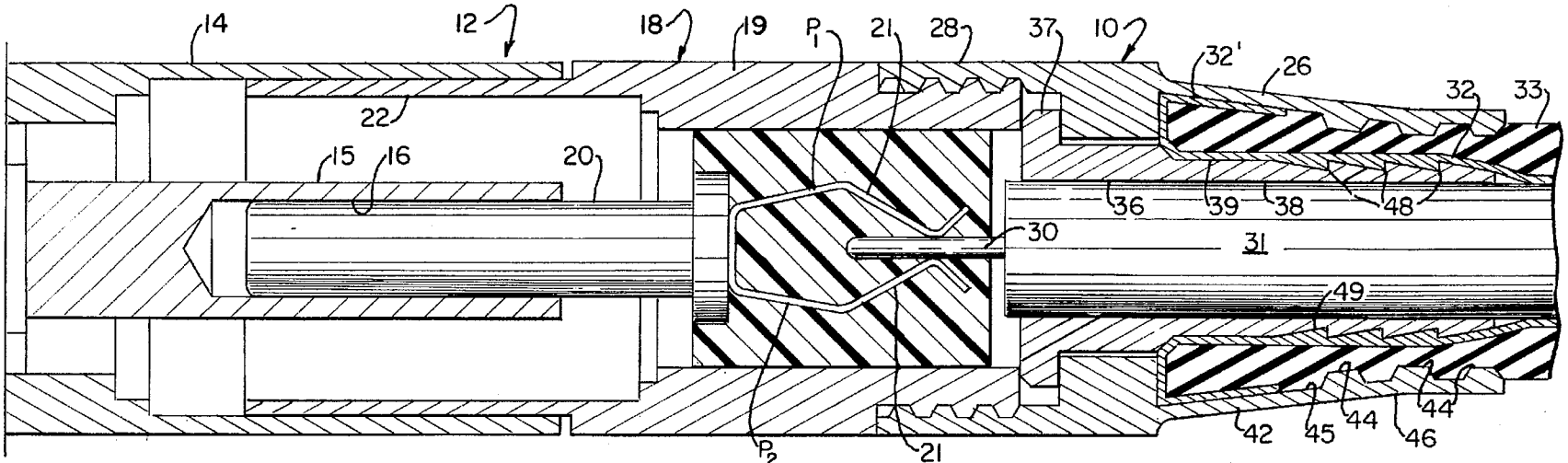
FIG. 1 is a longitudinal sectional view illustrating one preferred form of terminal connector assembly with the parts fully assembled and connected together with the end of a coaxial cable.
Figure 2:
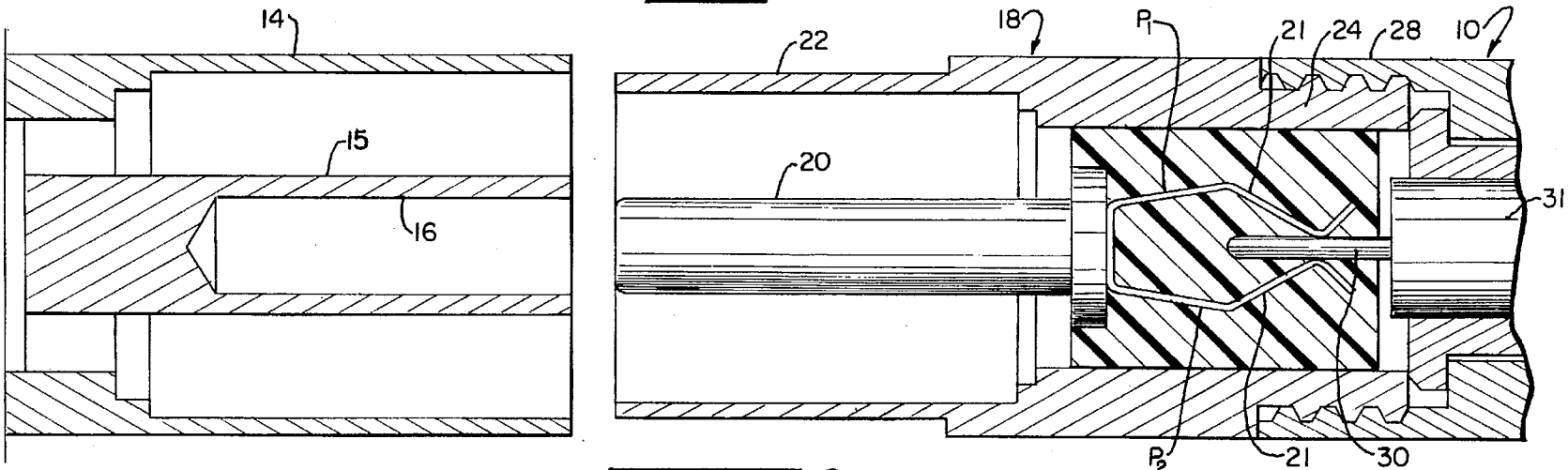
FIG. 2 is another longitudinal sectional view of the form of invention shown in FIG. 1 but with the adaptor and socket portions of the assembly separated from one another.

Referring in more detail to the drawings, there is shown by way of illustrative example in FIGS. 1 and 2 a connector assembly 10 for positively connecting a conventional form of coaxial cable C to an IEC terminal connector 12. As a setting for the present invention, the terminal connector 12 is of a type employed in European countries on television terminals in which a socket portion 14 extends from the terminal, not shown, with an inner spaced concentric tubular portion 15 having a counterbore 16. An adaptor 18 includes a hollow cylindrical portion 19 surrounding a pin 20 sized for close-fitting insertion into the counterbore 16, and contact portions defined by prongs $P_1$ and $P_2$ extend from one end of the pin 20 opposite to the counterbore 16 having spring-loaded, inwardly bowed ends 21 in normally contacting relation to one another. The cylindrical portion 19 has a male end 22 inserted in press-fit relation into the socket 14, and an opposite, externally threaded end 24 for threaded engagement with the connector fitting 10. The socket 14 has longitudinal slits 23 at circumferentially spaced intervals to enable slight expansion of the socket 14 for insertion of the end 22 in press-fit relation to one another and permit independent rotation between the adaptor 18 and socket portion 14. A potting compound forms a dielectric 25 surrounding the central conductor or female contact prongs $P_1$ and $P_2$.

The connector fitting 10 is broadly comprised of an outer sleeve 26 with a threaded connecting end portion 28 having internal threading complementary to the external threaded portion 24 of the adaptor 18. In accordance with conventional practice, the coaxial cable C is made up of an inner conductor 30, a dielectric insulator 31, outer braided conductor 32 and dielectric jacket 33, the latter being composed of a suitable rubber or rubber-like compound. The inner conductor 30 is in the form of a pin which is exposed by removing a limited length of the dielectric insulator 31, and a limited length 32' of the conductor 32 is peeled away from the insulator 31 and doubled over the outer jacket 33.

As shown in FIGS. 1 and 2, the connector fitting 10 has an inner sleeve 36 including an external shoulder or flange 37 at its forward end abutting the threaded end 24 of the adaptor 18 and a rearward extension 38 of reduced diameter and wall thickness in relation to the flange 37. The outer sleeve 26 has an internal flange or shoulder 40 in surrounding relation to the inner sleeve 36 and a rearward extension 42 of reduced diameter and thickness in relation to the flange 40 and disposed in outer spaced concentric relation to the inner sleeve extension 38 so as to form an annular space for insertion of the conductor 32 and jacket 33 between the extensions 38 and 42. The end connector 20 is also provided with external flats, not shown, to facilitate engagement by a hand wrench or other tool in order to thread the end portion 28 onto the threaded end 24 of the adaptor 18 and wedge the external flange 37 against the threaded end portion 24.

Sealed engagement is established between the connector fitting 10 and the cable C by means of endless sealing rings or ribs 44 of circular cross-section which extend circumferentially around the inner wall surface 45 of the extension 42. The ribs or protuberances 44 are disposed at uniform, axially spaced intervals so as to define grooves 46 therebetween, the grooves 46 being of a width substantially equal to the width of the ribs 44. Further, both the ribs 44 and grooves 46 are of rounded or circular cross-sectional configuration so that when crimped inwardly in a manner to be described will cause the elastic material of the jacket 33 to fill the grooves 46 and effectively form O-rings between the jacket 33 and the ribs 44. The ribs 44 are formed only along the crimping zone which is that length of the rearward extension 42 adjacent to its rearward end and spaced far enough from the opposite forward end of the extension 42 as to avoid contact with the braided conductor 32.

Preferably, the inner sleeve 38 is substantially coextensive with the outer sleeve 26, and a plurality of serrations or sawtooth edges 48 are formed on the external surface 39 of the inner sleeve 38 and in facing relation to the ribs 44 in order to grippingly engage the inner wall surface of the braided conductor 32. The serrations 48 are angled in a forward direction so that their apices 49 will resist rearward movement of the cable C with respect to the connector fitting 10.

In order to attach the connector fitting 10 onto the end of the cable C, the cable C is inserted with the exposed inner conductor 30 and insulator 31 extending through the inner sleeve 36. In turn, the outer braided conductor 32 and jacket 33 extend through the annular space between the rearward extensions 26 and 28 with the braided conductor end portion 32' wrapped around the forward end of the jacket 33. When the cable C is fully inserted into the connector 10, the end of the jacket 33 will abut the rearward end of the flange 40 on the outer sleeve 26, and the pin 30 will project slightly beyond the end of the insulator portion 31 for insertion between the pronged ends 21. Radially inward crimping of the rearward end of the extension 26 is preferably done by the use of a crimping tool of the type disclosed in my hereinbefore referred to application for U.S. Patent so as to cause uniform, radially inward reduction in diameter of the crimping zone and specifically the ribs 44 into sealing engagement with the jacket 33. Simultaneously, the serrations 48 are forced into firm engagement with the inner surface of the jacket 33.

In order to assemble the connector 20 onto the IEC connector assembly 12, the adaptor 18 is separated from the socket portion 14 and threaded onto the connector 10, as shown in FIG. 2. Thereafter, the adaptor 18 is inserted in press-fit relation to the socket 14 with the pin 20 extending through the sleeve 15 to complete the electrical connection between the cable C and terminal. In this relation, an inner continuous conductive path is established between the conductor pin 30 and sleeve 15 into the terminal, and an outer conductive path is established between the braided conductor 32 via the threaded end portions 24 and 28 through the adaptor 18 into the socket 14. The conductive paths as described are insulated from one another by the dielectric material. Further, it will be evident that different forms of terminal connections in place of the socket 14 may be utilized depending upon the configuration of the terminal, post, or wall plate.

DETAILED DESCRIPTION OF ALTERNATE PREFERRED FORM OF INVENTION

Figure 3:
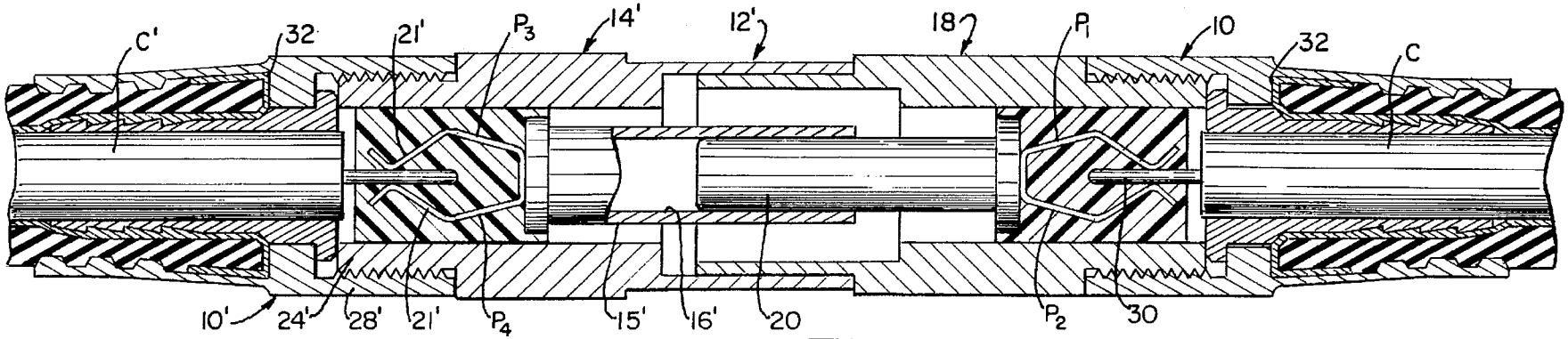
FIG. 3 is another longitudinal sectional view of an alternate form of invention for interconnecting two coaxial cables.

FIG. 3 illustrates another form of connector assembly 10' which is designed for interconnection or splicing of a pair of cables C and C' in a novel and improved manner. For example, the coaxial cable C' may extend from a wall plate and conductive paths must be established between the inner conductive pins 30 and outer conductive paths established between the braided conductors 32 of the cables C and C'. To this end, a modified form of IEC connector 12' comprises an end connector 10 and an adaptor 18 corresponding to that of the form shown in FIGS. 1 and 2 in combination with a modified form of socket member 14'. The socket 14' has an inner sleeve 15' for insertion of the conductor pin 20, and the end of the sleeve 15' opposite to counterbore 16' is provided with another female contact end defined by prongs $P_3$ and $P_4$ with spring-loaded inwardly bowed ends 21' coaxial with but facing in a direction opposite to the prongs $P_1$ and $P_2$. That end of the socket 14' opposite to the adaptor 18 is externally threaded as at 24' for threaded connection to a second end connector 10' corresponding to the end connector 10 of FIGS. 1 and 2. The coaxial cable C' is inserted and positively connected to the end connector 10' with the conductor pin 30 inserted between the inwardly bowed ends 21'. Both in the forms of FIGS. 1 and 2 as well as FIG. 3, the press-fit connection between the socket members 14 or 14' and the adaptor 18 permits independent rotation of the socket end of the connector with respect to the adaptor 18; and, in FIG. 3, the end connectors 10 and 10' are first individually assembled and crimped onto the cables C and C' and threaded onto their respective socket member 14' and adaptor 18, following which the adaptor 18 is then press-fit into secure connection with the socket 14'.

DETAILED DESCRIPTION OF ANOTHER MODIFIED FORM OF INVENTION

Figure 4:
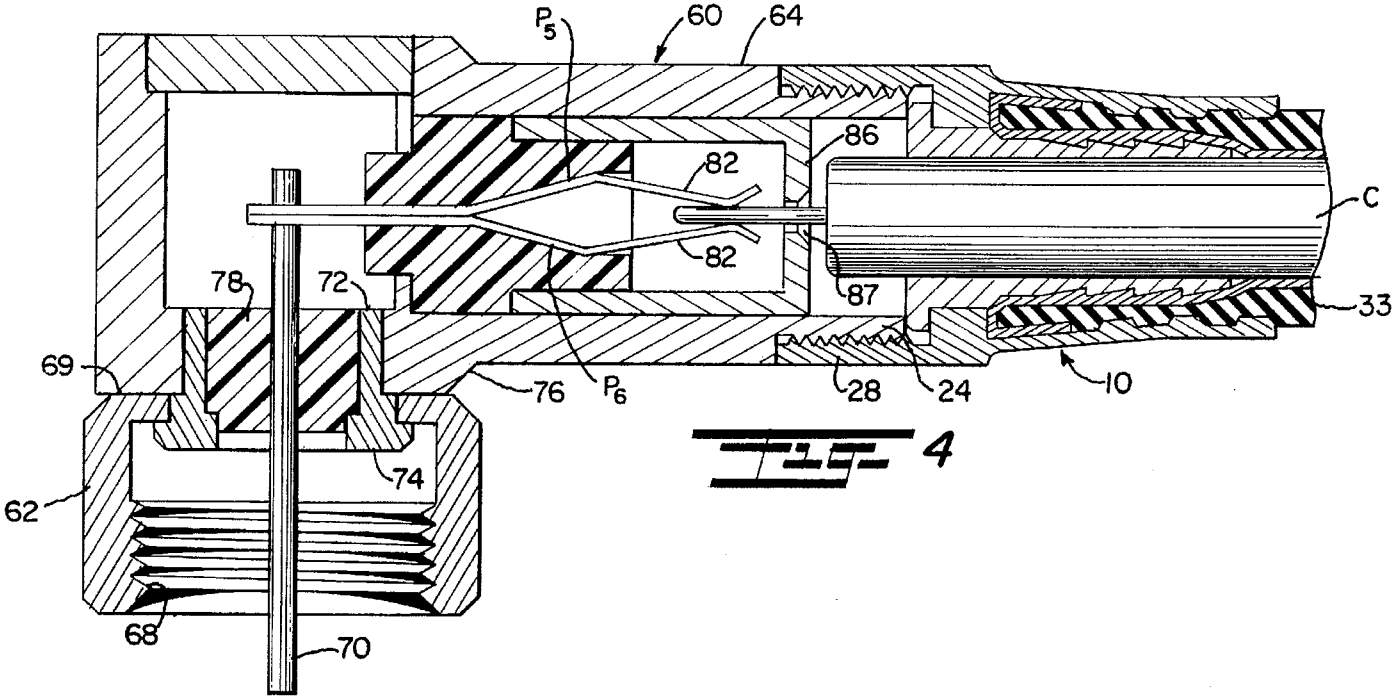
FIG. 4 is a longitudinal sectional view of a modified form of invention in which the adaptor and socket portions of the assembly are at right angles to one another.

In certain applications where space limitations preclude the use of a coaxial connection of the types shown in FIGS. 1 to 3, a right angle connector 60 has been devised in which a socket end portion 62 is threadedly secured to a terminal, not shown, and an adaptor 64 extends at right angles to the socket 62 with an end portion 66 for threaded engagement with threaded end 28' of an end connector 10. A coaxial cable C is positively attached to the end connector 10 in a manner corresponding to that of FIGS. 1 to 3 by crimping the outer sleeve 26 uniformly in an inward radial direction into sealing engagement with the jacket 33. The socket end portion 62 may be internally or externally threaded to mate with the threading on the terminal and, in the form illustrated in FIG. 4, is internally threaded as at 68 with a radially inwardly directed end portion 69 at one end. A conductor pin 70 extends centrally through a sleeve 72, the sleeve being press-fit into an opening in an enlarged side wall portion 76 of the adaptor 64 and having a shoulder portion 74 which retains the end 69 of the socket 62 against the enlarged sidewall portion 76. The pin 70 is centered with respect to the sleeve 72 by an insulating compound 78 placed in the sleeve 72 in a well-known manner, and is anchored at one end by closed, straight ends 80 of conductor prongs $P_5$ and $P_6$ centered within the adaptor 64 by an insulating compound 84 such that the inwardly bowed ends 82 project rearwardly toward the end connector fitting 10. The adaptor is of elongated cylindrical configuration and may suitably include an end cap 86 with a central opening 87 aligned with the bowed ends 82 for insertion of the conductor pin 30 of the connector 10.

Once assembled as described, there is some freedom of rotation between the adaptor 60 and socket portion 62, although it is important to maintain a continuous electrical path through the outer walls of the adaptor 60 and socket 62 in addition to the conductive paths established between the conductor pins 30 and 70.

It is therefore to be understood that while preferred and modified forms of invention are herein set forth and described, various modifications and changes may be made in the construction and arrangement of parts as well as composition of materials without departing from the spirit and scope of the present invention as defined by the appended claims.

I claim:

1. A terminal connector assembly for connecting an end of a coaxial cable to a terminal wherein said cable has radially inner and outer conductors separated by an annular dielectric, a tubular jacket encasing said outer conductor and a portion of said outer conductor being exposed at the end of said cable, said assembly comprising:

(a) an end connector having radially inner and outer spaced coaxial sleeves, said inner sleeve being sized for insertion of said inner conductor and said annular dielectric therein, said outer sleeve being sized for insertion of said conductor and said jacket through one end of said connector between said inner and outer sleeves;

(b) at least one rib extending circumferentially around an inner wall surface portion adjacent to the one end of said outer sleeve, said rib engaging an external surface of said jacket when said outer sleeve is deformed radially inwardly until said rib effects sealed engagement with said jacket;

(c) a terminal connector having a hollow generally cylindrical portion, an adaptor at one end of said cylindrical portion, a conductor member extending concentrically within said cylindrical portion and adaptor including contact portions at opposite ends thereof; and (d) said outer sleeve including a complementary connecting end portion to said adaptor connecting end portion for positively connecting said outer sleeve to said adaptor, said inner conductor electrically connected to one of said contact portions when said outer sleeve is positively connected to said adaptor.

2. A connector assembly according to claim 1, said adaptor connecting end portion and said outer sleeve connecting end portion having complementary threaded end portions.

3. A connector assembly according to claim 1, said inner conductor defined by a pin insertable into said one contact portion.

4. A connector assembly according to claim 1, said hollow generally cylindrical portion including a socket portion, and an adaptor extending at right angles to said socket portion.

5. A connector assembly according to claim 4, said terminal connector including a pin extending from said terminal, and said conductor member extending at right angles to said pin with another of said contact portions engaging said pin.

6. A terminal connector assembly for connecting an end of a coaxial cable to a terminal wherein said cable has radially inner and outer conductors separated by an annular dielectric, a tubular jacket encasing said outer conductor and a portion of said outer conductor being exposed at the end of said cable, said assembly comprising:

(a) an end connector having radially inner and outer spaced coaxial sleeves, said inner sleeve being sized for insertion of said inner conductor and said annular dielectric therein, said outer sleeve being sized for insertion of said conductor and said jacket through one end of said connector between said inner and outer sleeves;

(b) at least one endless sealing ring on an inner surface of said outer sleeve deformable into a portion of said jacket, and said inner sleeve having external projections along an external wall surface portion thereof adjacent to the one end thereof;

(c) a terminal connector having a hollow generally cylindrical portion, an adaptor at one end of said cylindrical portion, a conductor member extending concentrically within said cylindrical portion and adaptor including contact portions at opposite ends thereof; and (d) said outer sleeve including a complementary connecting end portion to said adaptor connecting end portion for positively connecting said outer sleeve to said adaptor, said inner conductor electrically connected to one of said contact portions when said outer sleeve is positively connected to said adaptor.

7. A connector assembly according to claim 6, there being a plurality of axially spaced sealing rings on said inner wall surface portion of said outer sleeve, said outer sleeve having an external surface portion of substantially uniform diameter throughout.

8. A connector assembly according to claim 7, said rings having intervening spaces therebetween with rounded surfaces of generally circular cross-sectional configuration.

9. A terminal connector assembly for connecting an end of a coaxial cable to a terminal wherein said cable and said terminal each has radially inner and outer, generally cylindrical conductors separated by an annular dielectric, a tubular jacket encasing said outer conductor and a portion of said outer conductor being exposed at the end of each said cable, said assembly comprising:

(a) an end connector for each said cable having radially inner and outer spaced coaxial sleeves, said inner sleeve being sized for insertion of said inner conductor and said annular dielectric therein, said outer sleeve being sized for insertion of said conductor and said jacket through one end of each said connector between said inner and outer sleeves;

(b) at least one endless circular rib extending circumferentially around an inner wall surface portion of each said outer sleeve adjacent to the one end of said outer sleeve, said rib engaging an external surface of said jacket when said cable is fully inserted into said connector and said outer sleeve is deformed radially inwardly until said rib effects sealed engagement with said jacket;

(c) a terminal connector having a generally cylindrical socket portion, an adaptor at one end of said socket portion, a conductor extending concentrically through said socket portion and adaptor including spring-loaded contact portions at opposite ends; and (d) each said outer sleeve including a complementary connecting end portion to one end of said adaptor and said socket portion for positively connecting each of said outer sleeves to one of said adaptor and said socket portion, said inner conductors electrically connected to said contact portions when said outer sleeves are positively connected to said adaptor and said socket portion.

10. A terminal connector assembly according to claim 9, said complementary connecting end portions defined by complementary threaded end portions.

11. A terminal conductor assembly portion according to claim 9, said inner sleeve being substantially coextensive with said outer sleeve.

12. A terminal conductor assembly according to claim 9, said adaptor being inserted in press-fit relation to one end of said socket portion.

13. A terminal conductor assembly according to claim 12, said socket portion having an expandable sleeve end portion for press-fit insertion of one end of said adaptor.

14. A terminal conductor assembly according to claim 9, said terminal connector conductor including a conductor pin inserted into a complementary sleeve portion when said adaptor is inserted in press-fit relation to said socket portion.

* * * * *